United States Patent [19]

Peterson

[11] 4,091,998

[45] May 30, 1978

[54] RETAINER CLAMP

[75] Inventor: Samuel F. Peterson, Chicago, Ill.

[73] Assignee: Associated Mills, Inc., Chicago, Ill.

[21] Appl. No.: 742,377

[22] Filed: Nov. 16, 1976

[51] Int. Cl.[2] ..... B05B 15/06

[52] U.S. Cl. ..... 239/283; 239/588

[58] Field of Search ..... 248/316 D, 226.5, 75; 239/282, 283, 530, 588

[56] References Cited

U.S. PATENT DOCUMENTS

| | | | |
|---|---|---|---|
| 2,161,855 | 6/1939 | Copell | 248/316 D |
| 3,637,143 | 1/1972 | Shames et al. | 239/283 |
| 3,807,675 | 4/1974 | Seckerson | 248/316 D |
| 3,865,310 | 2/1975 | Elkins | 239/283 |

*Primary Examiner*—John J. Love

*Attorney, Agent, or Firm*—Allegretti, Newitt, Witcoff & McAndrews

[57] ABSTRACT

An improved retainer clamp is disclosed for selectively and securely supporting a handheld showerhead so to as prevent any accidental dislodgement of the showerhead from the retainer clamp. The handheld showerhead is adapted to be connected, via a flexible conduit, with a source of water under pressure, such as the conventional shower pipe fitting normally found in bathrooms and the like, and may be supported by retainer clamp both while water is being sprayed from the showerhead and when the showerhead is not in use. The retainer clamp may be directly mounted on the shower fitting pipe and also may serve as the interconnection between the flexible conduit and the shower fitting pipe.

10 Claims, 7 Drawing Figures

Fig. 5
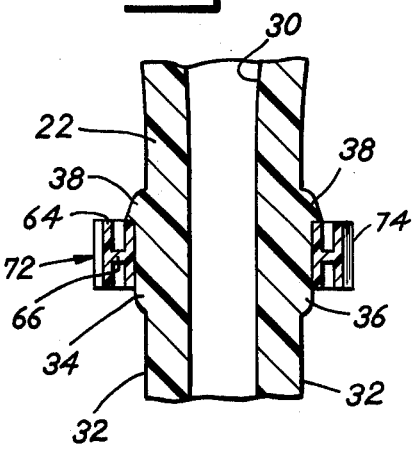
Fig. 6
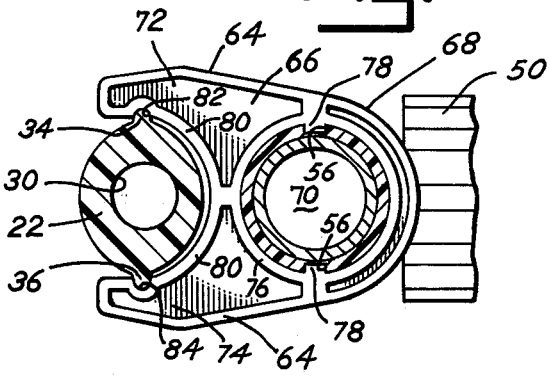
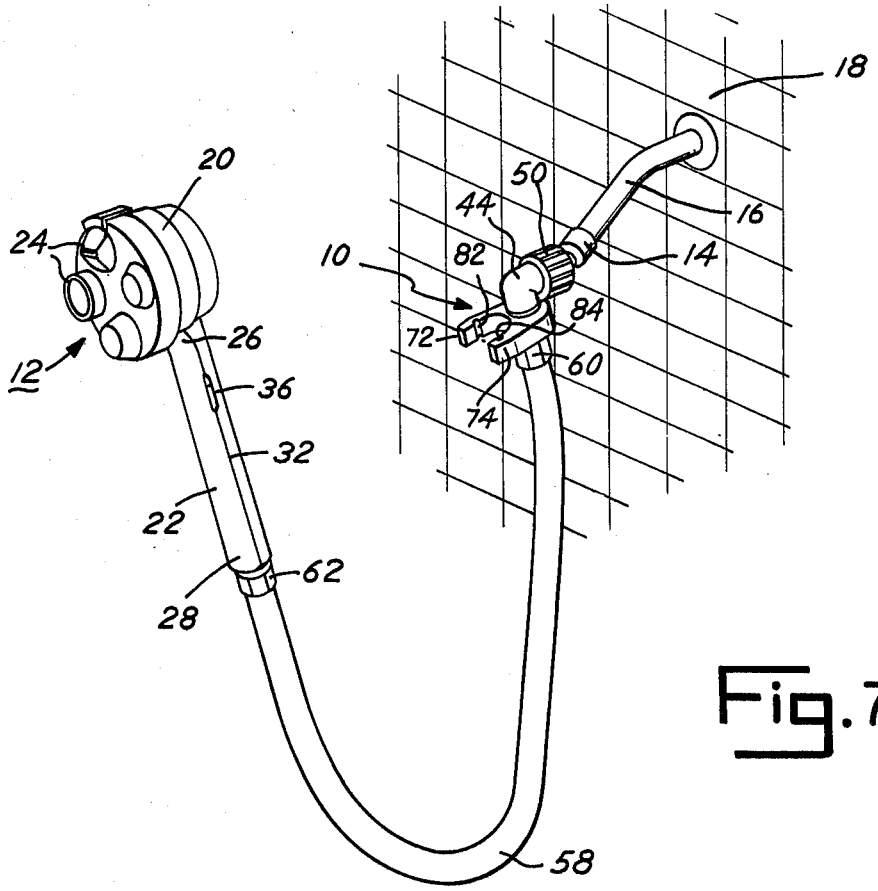
Fig. 7

RETAINER CLAMP

BACKGROUND AND SUMMARY OF THE INVENTION

The present invention relates to an improved retainer clamp, and more particularly, to an improved retainer clamp for selectively and securely supporting a handheld showerhead adapted to be connected, via a flexible conduit, with a source of water under pressure, such as a conventional shower pipe fitting found in bathrooms and the like.

In the past, other clamps and brackets have been proposed and used for supporting handheld showerheads. U.S. Pat. No. 3,865,310 discloses one such clamp which may be mounted on a shower pipe fitting and which may be utilized to selectively support a handheld showerhead. This patented clamp includes a pair of arms that are pivotedly mounted, intermediate their ends, on the body of the clamp and that are adapted to be moved between an opened position and a closed position. When the arms are in their open position, the handle portion of a handheld showerhead may be moved into and out of the space between the arms. When the arms are in their closed position, the arms serve to clamp the handle portion of a handheld showerhead. The arms may be moved between their open and closed positions and between their closed and open positions by pressing the handle portion of a handheld showerhead against the ends of the arms.

While this patented clamp generally performs its intended functions satisfactorily, it does appear to have a serious disadvantage from the standpoint of safety. When a handheld showerhead is supported by the patented clamp, the longitudinal axes of its handle portion is generally disposed perpendicularly to the plane which includes the axes of the arms of the clamp and the arms, in their closed position, surround the handle portion adjacent to the nozzle portion of the showerhead. The arms of the clamp may be inadvertently opened as a result of the distal end of the handle portion being moved, at an angle with respect to the clamp, such that the part of the handle portion surround by the clamp forces the arms apart. Such angular movement may be caused by someone bumping the handle portion of the showerhead or accidently pulling on the flexible conduit connected with the showerhead. Such an opening of the arms of the clamp will, of course, result in the showerhead being dislodged from the clamp. This obviously presents a potential danger to persons, and particularly smaller children, who are standing underneath or near the showerhead.

Accordingly it is a primary object of my present invention to provide an improved retainer clamp for a handheld showerhead wherein my improved retainer clamp supports the showerhead so as to prevent accidental dislodgement of the showerhead. Another object and advantage of my present invention is to provide an improved showerhead retainer clamp of the type described which utilizes no moving parts, which may be manufactured relatively inexpensively and which is, designed so that a handheld showerhead may be quickly and securely mounted in the retainer clamp.

My improved showerhead retainer clamp has a main supporting bracket that includes a first, fixture portion of the main supporting bracket is utilized to secure the retainer clamp adjacent to where the handheld showerhead is to be used, and preferably, on the end of a conventional shower pipe fitting often found in bathrooms and the like. The second clamping portion of the main supporting bracket includes curved, generally "U" shaped, bifurcated arm members which are spaced from one another so that a part of the handle portion of the showerhead may be disposed between the arm members and which have their central longitudinal axes disposed in a first plane.

The arm members are made of a plastic material which permits the arms to be slightly forced apart, in the first plane, although otherwise, the arm members are relatively rigid. Each of the arm members has a groove formed therein between its ends, with the longitudinal axes of the grooves being disposed in a second plane that is generally perpendicular to the first plane. These grooves have a size and shape so that they are capable of receiving diametrically opposed, radially outwardly projecting lugs formed on the part of the handle portion of the handheld showerhead. The distance between the arm members, as measured from adjacent to the grooves, is slightly less than the distance between the outer distal edges of the radially outwardly projecting lugs, but is slightly greater than the cross-sectional dimension of the handle portion, as measured from adjacent to the bases of these radially outwardly projecting lugs. Thus when the radially outwardly projecting lugs are disposed adjacent to the grooves, and the handle portion is then moved angularly, about its longitudinal axis, in the direction of the grooves and with respect to the second portion of the main supporting bracket the lugs force the arms apart so that they can be "snapped" i.e. received, within the grooves. Of course when the lugs are disposed within the grooves, further relative angular movement between the handle portion and the arms is restricted and can only be accomplished by applying sufficient force so as to "snap" the lugs out of the grooves.

The upper ends of the radially outwardly projecting lugs are enlarged so that their dimensions are greater than the dimensions of the groove. Hence when lugs are disposed within the grooves, the lugs, and thus the showerhead, cannot be moved downwardly, with respect to the arm members. In addition, the handle portion of the showerhead includes, between the radially outwardly projecting lugs and the distal end of the handle portion, a pair of defined, diametrically opposed edges that are disposed within a common plane with the lugs. The handle portion is tapered so that the distance between the edges is greater adjacent to the distal end than adjacent to the lugs. If the showerhead is moved upwardly, relative to the arm members of the retainer clamp, the edges will then be received within the grooves. Although it takes much less force to "snap" these edges out of engagement with the grooves than it does to "snap" the lugs out of the grooves (as a practical matter, it is almost "impossible" to snap the lugs directly out of the grooves), the engagement between the edges and the grooves, effectively prevents the showerhead from being accidentally dislodged from the retainer clamp even if the showerhead should inadvertently bumped upwardly.

In summary, the showerhead cannot be inadvertently dislodged from my retainer clamp by the distal end of the handle portion being accidentally bumped. Rather the showerhead is removed from my improved retainer clamp by moving the showerhead upwardly, with respect to the clamp, until the lugs are no longer in engagement with the grooves. The handle portion is then forcible rotated, about its longitudinal axis, so that the diametrically opposed edges are "snapped" out of engagement with the grooves in the arm members. Once the edges are no longer engaged with the grooves, the handle portion of the showerhead may be then withdrawn from between the arm members. In other words, the showerhead can be dislodged from my retainer clamp only when the showerhead is positively moved upwardly, along a path coaxial with the longitudinal axes of the handle portion, and while in this upward position, is then further positively rotated about the longitudinal axis of the handle portion. Accordingly the improved retainer clamp of my present invention securely supports the handheld showerhead so as to effectively prevent any accidental dislodgement of the showerhead from the clamp.

These and other object and advantages of my present invention will become apparent from the following description of the preferred embodiment of my invention which is described in connection with the accompanying drawings.

DESCRIPTION OF THE DRAWINGS

FIG. 5 is a cross-sectional view taken along the line 5—5 in FIG. 3.

FIG. 6 is a cross-sectional view taken along the line 6—6 in FIG. 3.

FIG. 7 is a perspective view similar to that shown in FIG. 1 except that the handheld showerhead is shown dislodged from the improved retainer clamp of the present invention.

Figure 1:
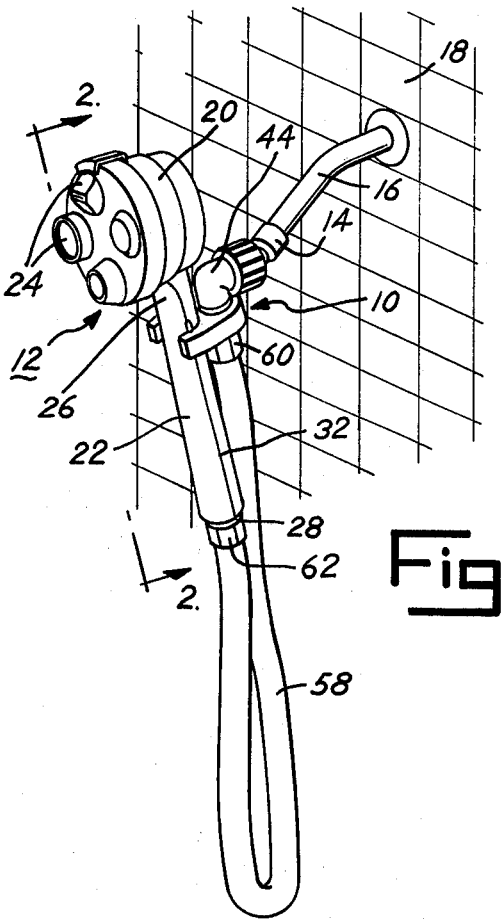
FIG. 1 is a perspective view of a handheld showerhead being supported by improved retainer clamp of my present invention.

Throughout the various figures of the drawings, the same reference numerals will be used to designate the same parts and components. Moreover when the terms "right", "left", "upper", "lower", "upper end" and "lower end" are used herein, it is to be understood that these terms have reference to the structure as shown in the drawings as it would appear to a person viewing the drawings.

DESCRIPTION OF THE PREFERRED EMBODIMENT

Referring now to FIG. 1, an improved retainer clamp 10 of my present invention is shown supporting a handheld showerhead 12 in a bathroom or the like. As is more specifically described hereinafter, the retainer clamp 10 is mounted on the distal end 14 of a conventional shower pipe fitting 16 which projects from the wall 18 of a bathroom where the showerhead is to be utilized.

Figure 2:
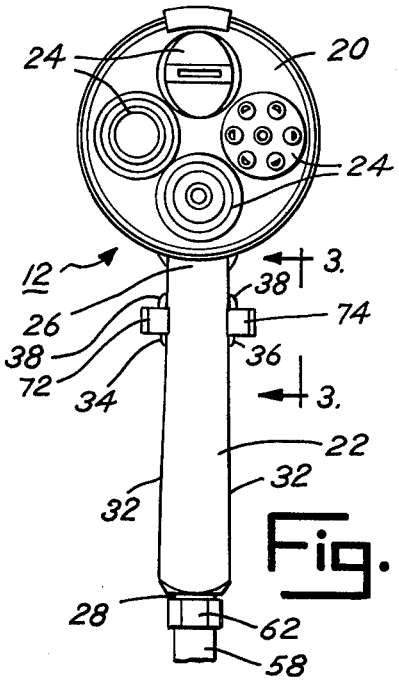
FIG. 2 is an elevational view taken along the line 2—2 in FIG. 1.

Except as hereinafter noted, the handheld showerhead 12 preferably has a construction identical to that described in the Copending Peterson et al United States patent application Ser. No. 682,988, filed May 4, 1976 and assigned to the assignee of this application. The handheld showerhead 12 includes a generally cylindrical nozzle head 20 and an integral handle 22. As best illustrated in FIGS. 1, 2 and 7, the nozzle portion 20 includes a plurality of spray apertures 24, and the user of the showerhead 20 may selectively move a spray aperature 24 into communication with the flow of water so as to permit water to be sprayed from the showerhead 12 in a variety of different spray patterns. The handle 22 has an end 26 adjacent to the nozzle head 20 and a threaded distal end 28. The handle 22 is tubular and includes an axial passage 30 therein which extends from one end 26 to the other end 28 and which defines a flow path for the water to be sprayed from the showerhead 12.

The showerhead 12 is preferably molded from a plastic material. As noted above, the handle 22 is preferably molded as an integral part of the nozzle head 20.

Figure 4:
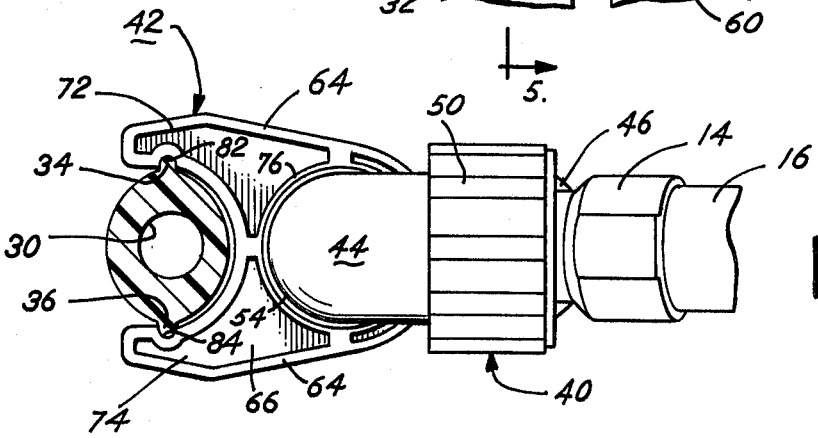
FIG. 4 is a partial, cross-sectional view taken along the line 4—4 in FIG. 3.

As shown in FIGS. 2, 4 and 6, the handle 22 has a generally oval, outer cross-sectional configuration. The handle is uniformly tapered so that the major axis of the oval cross-section is smaller adjacent to the end 26 than adjacent to the distal end 28. In addition, the oval cross-section is not exactly smooth or continuous in that there are two axial edges or ridges 32 formed in the outer surface of the handle 22. These edges 32 extend generally from the end 26 to the distal end 28 of the handle and are disposed in a plane which includes the major axis of the oval cross-section and also the longitudinal central axis of the handle 22.

A pair of diametrically, opposed, radially outwardly projecting lugs 34 and 36 are integrally formed on the handle 22 adjacent to the end 26, viz. about a third of the way from the end 26 to the end 28. These lugs 34 and 36 extend radially outwardly beyond the outer surface of the handle 22 and are aligned with and are disposed in the same plane as the edges 32. The lugs 34 and 36 have a uniform cross-sectional dimension except that each has a head 38 formed on its upper end, i.e. the end of the lug adjacent to the end 24 of the handle 22. The heads 38 project radially outwardly father from the outer surface of the handle than do the rest of the lugs.

Figure 3:
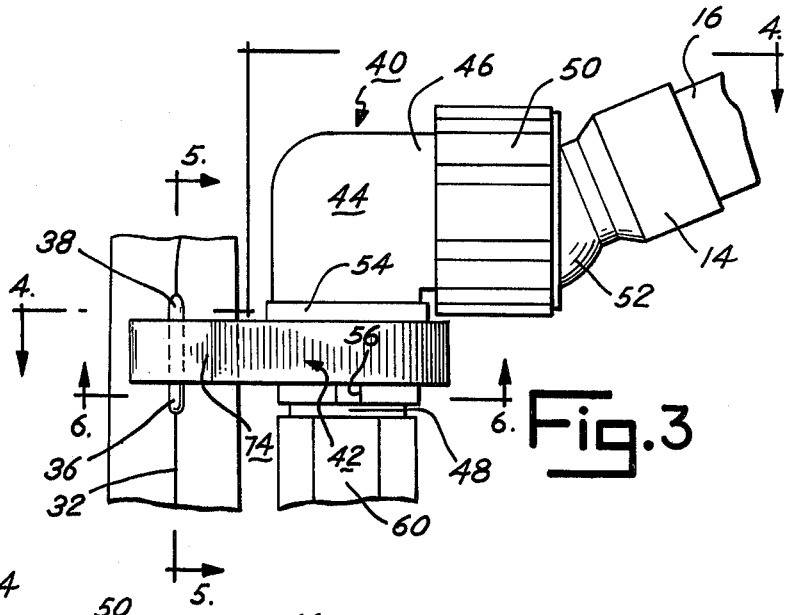
FIG. 3 is a partial, side plan view taken along the line 3—3 in FIG. 2.

As best shown in FIGS. 3-6, the retainer clamp 10 includes a fixture portion 40 and a clamping portion 42 which are interconnected as hereinafter more specifically described. The fixture portion 40 comprises a tubular elbow 44 which is preferably molded of a plastic material and which has threads formed on both its upper and lower ends 46 and 48. A conventional nut 50 is adapted to fit about a swivel ball 52 which normally constitutes the terminal portion of the distal end 28 of the shower pipe fitting 16 and to be threaded on the upper end 46 of the elbow 44 so that the swivel ball 52 will be received and secured between the nut 50 and the upper end 46 of the elbow 44. When the swivel ball 52 is clamped between the nut 50 and the elbow 42, as seen in FIGS. 3 and 4, the retainer clamp 10 is securely mounted on the distal end 14 of the shower pipe fitting 16.

An integral circular flange 54 is formed on the elbow 44 adjacent to but spaced slightly upwardly from its lower end 48. A pair of diametrically opposed, vertically disposed slots 56 are formed in the flange 54. As noted above, the elbow 44 is tubular and cooperates with the showerhead pipe fitting 16 so that water flowing through the shower fitting pipe 16 also flows through the elbow 42.

A flexible conduit 58 interconnects the lower end 48 of the elbow 44 with the distal end 28 of the handle 22 of the showerhead 12. More specifically a nut 60, carried by the flexible conduit 58, is threadily received on the lower end 48 of the elbow 44 while a nut 62, also carried by the flexible conduit, is threadily received on the distal end 28 of the handle 22. Thus water flowing from the shower fitting pipe 16 will flow through the elbow 44, the flexible conduit 58, the passage 30 in the handle 22 and out through one of the spray apertures formed in the nozzle head 20 of the showerhead 12.

The clamping portion 40 of the retainer clamp 10 is preferably molded from a plastic material and as best shown in FIGS. 4–6, has a vertically disposed, continuous peripherial flange 64 and a horizontally disposed, central web 66. The clamping portion 40 is divided into a collar section 68 which has a circular aperature 70 therein and a pair of bifurcated, generally "U" shaped arms 72 and 74.

The collar section 68 is adapted to fit around the elbow 44, with the upper edge of the flange 76, which surrounds the aperature 70, abating the lower edge of the flange 54 so that the collar section 68 is positioned on the elbow 44 between the flange 54 and the lower end 44, i.e. the nut 60. A pair of diametrically opposed, radially inwardly directed projections 78 are formed on the flange 76 and extend into the aperature 70. These projections 78 are disposed within the slots 56 so as to prevent any relative rotational movement between the clamping portion 40 and the elbow 44. A conventional adhesive may be used to permanently secure the collar section 68 and elbow 44 can be molded as a unitary piece particularly since for all intent and purposes, the use of adhesive renders the portion 40 and the elbow 44 inseparable.

The arm 72 and 74 are spaced from one another so that the oval cross-section of the handle 22 can be received between the arms. The length of the arms 72 and 74 are selected so that their distal ends extend beyond the major axis of the oval cross-section of the handle 22 when the handle is positioned between the arms and adjacent to the portions 80 of the flange 64 that defines inner facing surfaces of the arms. Grooves 82 and 84 are formed in the arms 72 and 74, respectively, i.e. in the portions 80 of the flange 64. The longitudinal axes of these grooves 82 and 84 are generally vertically disposed i.e. perpendicular to a plane defined by the longitudinal central axes of the arms 72 and 74 and the grooves 82 and 84 are formed so that the lugs 34 and 36 may be snugly received therein. The distance between the arms 72 and 74, immediately adjacent to the grooves 82 and 84, is slightly less than the cross-sectional distance between the lugs 34 and 36 although the distance between the radial outer edges of the lugs 34 and 36 is less than the distance between the "bottoms" of the grooves 82 and 84. The arms 72 and 74 are constructed so that they have a limited degree of flexibility or resiliency i.e. they can be slightly forced apart, in a plane perpendicular to the longitudinal axes of the grooves 82 and 84. The lugs 34 and 36 may be disposed within the grooves 82 and 84 by placing the handle 22 between the arms 72 and 74 such that the lugs 34 and 36 positioned adjacent to the grooves 82 and 84, and thereafter rotating or twisting the handle 22, about its longitudinal axis, so that the lugs are "snapped" into the grooves as noted above after the lugs 34 and 36 have once been disposed within the grooves 82 and 84, they can be removed therefrom by moving the handle 22 upwardly until the lugs 34 and 36 are no longer disposed within the grooves 82 and 84 and by then rotating or twisting the handle 22 about its longitudinal axis. As noted above, after the handle 22 has been raised upwardly at least the length of the lugs, the edges 32 are disposed within the grooves 82 and 84. Rotational or twisting movement of hande 22 results in the edges 32 being "snapped" out of engagement with the grooves, so that the handle can be removed from between the arms 72 and 74.

As also noted above, the heads 38 of the lugs 34 and 36 cannot be accommodated within the grooves 82 and 84. Hence the handle 22, and thus the showerhead 12, can never be moved downwardly, with respect to the clamping portion 42, once the lugs 34 and 36 have been "snapped" into engagement with the grooves 82 and 84.

As a result of the construction of the grooves 82 and 84 and the cooperation between these grooves and the lugs 34 and 36, it is almost impossible for a person to inadvertently dislodge the handheld showerhead 12 from the improved retainer clamp 10, particularly by bumping or pulling on the flexible conduit 58. Thus my improved retainer clamp 10 affords a significant advantage, from the standpoint of safety, in that it eliminates substantially all risk that the showerhead 12 will be accidentally dislodged from the retainer clamp.

From the foregoing, it should be apparent to those having skill inthis art that my invention, as disclosed herein, may be embodied in other specific forms without departing from the spirit or central characteristics thereof. Thus the preferred embodiment described hereinabove, is therefore to be considered in all respects as illustrative and not restrictive, the scope of my invention being indicated by the appended claims, rather than by the foregoing description, and all changes which come within the meaning and range of equivalency of the claims are therefore intended to be embraced therein.

I claim:

1. An improved retainer clamp and showerhead assembly for selectively and securely supporting a handheld showerhead wherein the handheld showerhead includes a nozzle portion and a handle portion which is connected at one end to the nozzle portion and which has a pair of opposed, radially outwardly projecting lugs that are formed on one part of the handle portion, between its one end and its distal end, and that are disposed in a first plane also including the longitudinal central axis of the handle portion, wherein the handheld showerhead is adapted to be connected with a source of water under pressure such as it conventionally found in the bathrooms or the like, and wherein the handheld showerhead may be supported by the retainer clamp while water is being sprayed therefrom and when the handheld showerhead is not in use, an improved retainer clamp comprising:

a main supporting bracket that includes a first, fixture portion and a second, clamping portion;

the first fixture portion of the main supporting bracket including means for mounting the main supporting bracket in the bathroom or the like;

the second clamping portion of the main supporting bracket including two curved, generally "U" shaped arm members which are spaced from one another such that the one part of the handle portion may be disposed between the arm members and which have their central longitudinal axes disposed in a second plane, each arm member having a groove formed therein between its ends, with the longitudinal axes of the grooves being disposed in a third plane that is generally perpendicular to the second plane, with the grooves having a size and shape such that the radially outwardly projecting lugs may be received therein and with the distance between the arm members, as measured from adjacent to the grooves, being slightly less than the distance between the radially outer distal edges of the radially outwardly projecting lugs but greater than the cross-sectional dimension of the handle portion, as measured in the first plane and from adjacent to the bases of the radially outwardly projecting lugs, so that when the outwardly projecting lugs are disposed within the grooves, relative angular movement, about the longitudinal axis of the handle portion, between the handle portion and the second portion of the main supporting bracket is restricted; and means for limiting axial movement of the handle portion, with respect to the second portion of the main supporting bracket, in one direction when the radially outwardly projecting lugs are disposed within the grooves.

2. The improved retainer clamp and showerhead assembly as described in claim 1 wherein the arm members are made of a plastic material so that they may be forced to move slightly apart, in the second plane, from their normal positions when the radially outwardly lugs are disposed adjacent to the grooves and when the handle portion is rotated about its longitudinal axis, toward the grooves.

3. The improved retainer clamp and showerhead assembly as described in claim 1 wherein the cross-sectional dimenstion of the handle portion, as measured in the first plane, is larger at the distal end of the handle portion than at the one part of the handle portion and uniformly increases between the one part and the distal end; and wherein an edge is formed on each side of the handle portion, in the second plane, and may be disposed within the grooves when the handle portion is moved, parallel to the first plane and relatively to the main supporting bracket, in a direction away from its distal end.

4. The improved retainer clamp and showerhead assembly as described in claim 1 wherein the ends of the radially outwardly projecting lugs adjacent to the one end of the handle portion are enlarged, as compared with the remainder of the lug, so that these enlarged ends are larger than the cross-sectional dimensions of the grooves.

5. The improved retainer clamp and showerhead assembly as described in claim 1 wherein the first and second portions of the main supporting bracket are interconnected so that there is no relative movement therebetween; and wherein the first portion of the main supporting bracket includes a tubular member which is adapted to be connected at one end with the showerhead pipe fitting and which is adapted to be connected at its other end with the flexible tube.

6. The improved retainer clamp and showerhead assembly as described in claim 1 wherein the distal end of the handle portion is connected, through a flexible conduit, with a shower pipe fitting; and wherein the first portion of the main supporting bracket is mounted on the shower pipe fitting.

7. The improved retainer clamp and showerhead assembly as described in claim 2 wherein the cross-sectional dimension of the handle portion, as measured in the first plane, is larger at the distal end of the handle portion than at the one part of the handle portion and uniformly increases between the one part and the distal end; and wherein an edge is formed on each side of the handle portion, in the second plane, and may be disposed within the grooves when the handle portion is moved parallel to the first plane and relatively to the main supporting bracket, in a direction away from its distal end.

8. The improved retainer clamp and showerhead assembly as described in claim 7 wherein the ends of the radially outwardly projecting lugs, adjacent to the one end of the handle portion are enlarged, as compared with the remainder of the lug so that these enlarged ends are larger than the cross-sectional dimension of the grooves.

9. The improved retainer clamp and showerhead assembly as described in claim 8 wherein the first and second portions of the main supporting bracket are interconnected so that there is no relative movement therebetween; wherein the distal end of the handle portion is connected, through a flexible conduit, with a shower pipe fitting; and wherein the first portion of the main supporting bracket is mounted on the showerhead pipe fitting.

10. The improved retainer clamp and showerhead assembly as described in claim 9 wherein the first portion of the main supporting bracket includes a tubular member which is adapted to be connected at one end with the showerhead pipe fitting and which is adapted to be connected at its other end with the flexible tube.

* * * * *